United States Patent [19]

Sano et al.

[11] Patent Number: 4,519,214

[45] Date of Patent: May 28, 1985

[54] AIR CONDITIONER

[75] Inventors: Tetsuo Sano, Fujinomiya; Susumu Orita, Fuji; Masaya Yamazaki, Shimizu; Kazuhiro Moriyama, Fuji, all of Japan

[73] Assignee: Tokyo Shibaura Denki Kabushiki Kaisha, Kawasaki, Japan

[21] Appl. No.: 567,344

[22] Filed: Dec. 30, 1983

[30] Foreign Application Priority Data

Jan. 17, 1983 [JP] Japan ..... 58-5479

[51] Int. Cl.[3] ..... F25D 21/06; F25B 13/00

[52] U.S. Cl. ..... 62/156; 62/160; 62/196.3; 62/278; 62/324.5

[58] Field of Search ..... 62/160, 278, 196.4, 62/196.3, 196.1, 81, 324.1, 324.5, 324.6, 156

[56] References Cited

U.S. PATENT DOCUMENTS

| | | | |
|---|---|---|---|
| 2,968,167 | 1/1961 | Raney | 62/160 X |
| 3,444,699 | 5/1969 | Harnish | 62/160 X |
| 4,137,726 | 2/1979 | Watada | 62/324.6 X |

FOREIGN PATENT DOCUMENTS

| | | | |
|---|---|---|---|
| 0019736 | 12/1980 | European Pat. Off. . | |
| 1076 | 1/1978 | Japan . | |
| 16758 | 2/1979 | Japan | 62/324.6 |
| 51048 | 4/1979 | Japan | 62/324.6 |
| 44298 | 9/1982 | Japan . | |
| 1143647 | 2/1969 | United Kingdom . | |
| 1508087 | 4/1978 | United Kingdom . | |

*Primary Examiner*—Harry Tanner

[57] ABSTRACT

An air conditioner includes a compressor, four-way valve, outdoor side heat exchanger, expansion valve and indoor side heating exchanger, which components are sequentially connected via coolant tubes, thereby constructing a refrigeration cycle circuit which is capable of performing cooling (defrosting) and heating operations. A switching control valve is connected between the suction side of the compressor and the four-way valve. The control valve is opened when abnormal high pressure is produced in the refrigeration cycle and when the defrosting operation is performed. A first branch passage is connected at its one end between the four-way valve and indoor side heat exchanger, and at the other end to the control valve. During the heating operation, when the control valve is opened, the first branch passage forms a releasing circuit, thereby releasing the abnormal high pressure to the low pressure side of the refrigeration cycle. A second branch passage is connected at its one end between the outdoor side heat exchanger and the expansion valve and at the other end to the control valve. During the defrosting operation, the second branch passage forms a short-circuit which sequentially passes the compressor, four-way valve, outdoor side heat exchanger and control valve.

5 Claims, 4 Drawing Figures

AIR CONDITIONER

BACKGROUND OF THE INVENTION

The present invention relates to an air conditioner which is capable of cooling and heating a room, as well as defrosting at a room heating time.

An air conditioner of the above type generally has a compressor, a four-way valve, an outdoor side heat exchanger, an expansion valve which serves as a pressure reducing device, and an indoor side heat exchanger; which components are sequentially connected via a coolant tube, thereby constructing a refrigeration cycle circuit which is capable of performing cooling (defrosting) and heating operations.

Abnormally high pressure might occur in the air conditioner at the high pressure side of the refrigeration cycle, during the heating operation, due to a variation in the atmospheric temperature. Thus, one conventional type of air conditioner, such as that disclosed in Japanese Utility Publication No. 1076/1978, has a releasing circuit for releasing the generated high pressure to the low pressure side of the refrigeration cycle circuit, and a switching control valve which is provided within the releasing circuit.

When a cooling (defrosting) operation is carried out, the four-way valve is switched to the room cooling side, and the compressor is then driven. Thus, coolant sequentially flows from the compressor, through the four-way valve, outdoor side heat exchanger, expansion valve and indoor side heat exchanger, thereby forming a cooling cycle (defrosting cycle).

When a heating operation is performed, the four-way valve is switched to a room heating side, and the coolant sequentially flows from the compressor, through the four-way valve, indoor side heat exchanger, expansion valve and outdoor side heat exchanger, thereby forming a heating cycle.

When abnormal pressure is produced at the high pressure side of the refrigeration cycle, due to an overload at the heating operation, the control valve is opened, with the result that the high pressure is released to the low pressure side of the refrigeration cycle.

In the refrigeration cycle circuit of the above-described type, the throttling amount of the expansion valve is normally controlled on the basis of the refrigeration cycle temperature detected by a sensor such as a heat sensitive tube provided at the suction side of the compressor. However, when the defrosting operation is carried out by a reverse cycle (cooling cycle) during the heating operation, i.e., when the heating operation is temporarily transferred to the cooling operation to remove frost adhered to the outdoor side heat exchanger, extremely cooled coolant flows to the suction side of the compressor. Therefore, this low temperature is detected by the sensor and, since the defrosting operation is performed in a state wherein the throttling amount of the expansion valve is increased, the expansion valve is substantially closed. Consequently, the coolant hardly flows in the refrigeration cycle, during the defrosting operation, resulting in a deterioration of the defrosting performance.

In order to solve the above-described problem, it is considered that a shortcircuit between the outdoor side heat exchanger and the indoor side heat exchanger is created to inhibit the refrigerant from passing through the expansion valve at the defrosting time. However, in this case, a switching control valve for the shortcircuit is additionally needed by the control valve of the above-described releasing circuit. Since the control valve is expensive, it is not economically feasible to employ two control valves. Further, another control means for controlling these two control valves is also required, thereby so increasing the manufacturing cost as not to be practical.

SUMMARY OF THE INVENTION

The present invention has been made in consideration of the above circumstances and has for its object to provide an air conditioner capable of releasing abnormally high pressure produced at the high pressure side of the refrigeration cycle, efficiently defrosting and simultaneously facilitating the control function, by using a single switching control valve.

According to an aspect of the present invention, there is provided an air conditioner which comprises a compressor; a four-way valve connected between the exhaust side and the suction side of the compressor, which valve is capable of being switched between a cooling position and a heating position; an outdoor side heat exchanger connected to one side of the valve; an indoor side heat exchanger connected to the other side of the valve; an expansion valve connected between the outdoor side heat exchanger and the indoor side heat exchanger, the throttling amount of the expansion valve being regulated in response to refrigerant temperature; a switching control valve connected to the suction side of the compressor, which valve is released when high pressure is produced at the high pressure side of the air conditioner at a heating operation and at a defrosting operation; a first branch passage connected at one end between the four-way valve and the indoor side heat exchanger, and at the other end to the switching control valve for releasing the high pressure produced at the high pressure side of the air conditioner to the indoor side heat exchanger when the switching control valve is opened during the heating operation; and a second branch passage connected at one end between the outdoor side heat exchanger and the expansion valve, and at the other end to the switching control valve for forming a shortcircuit for sequentially passing the compressor, four-way valve, outdoor side heat exchanger and switching control valve at the defrosting operation.

According to the air conditioner of the present invention, when abnormally high pressure is produced at the high pressure side of the refrigerant cycle during the heating operation, since the first branch passage is provided, said high pressure can be released to the low pressure side of the refrigeration cycle, thereby protecting the compressor from damage. Further, since the second branch passage is provided, the shortcircuit which sequentially passes the compressor, four-way valve, outdoor side heat exchanger and switching control valve is formed in the case of a defrosting operation. Therefore, in the case of the defrosting operation, coolant does not pass the expansion valve, thereby improving the defrosting efficiency. In addition, the first and second branch passage are opened and closed by a sole switching control valve. Thus, it is not necessary to provide an additional switching control valve, thereby reducing the manufacturing cost of the air conditioner. Further, since only a single control system is enough, the control function is facilitated. Finally, since the air conditioner additionally has only the first and second branch passages, its structure is simplified.

DETAILED DESCRIPTION OF THE PREFERRED EMBODIMENTS

An embodiment of an air conditioner according to the present invention will be described with reference to the drawings.

Figure 1:
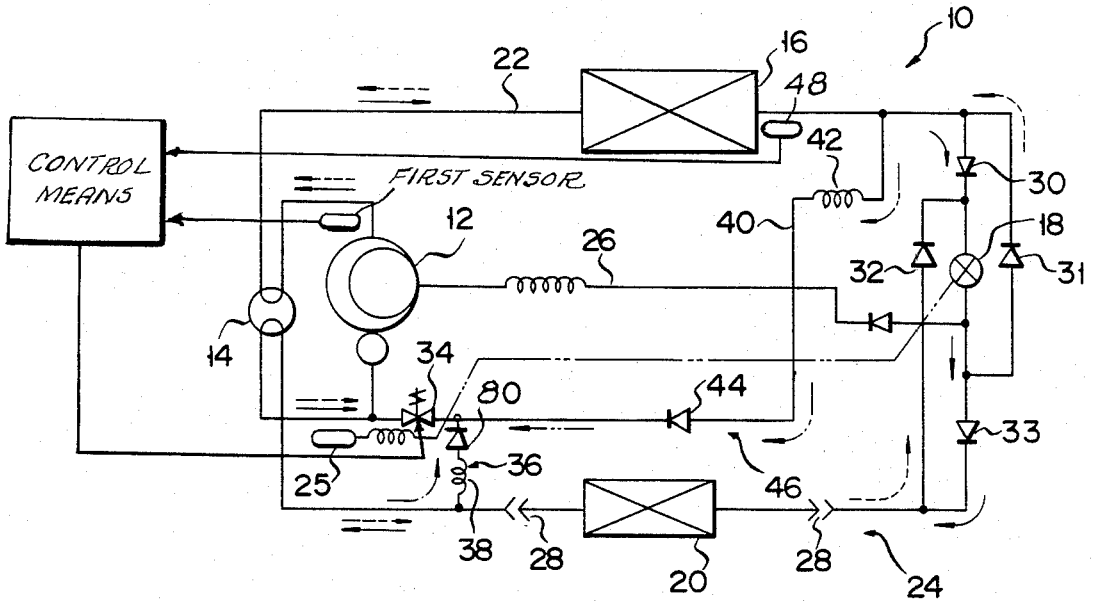
FIG. 1 is a block circuit diagram of an air conditioner according to an embodiment of the present invention.

As shown in FIG. 1, an air conditioner 10 comprises a variable capacity type compressor 12, a four-way valve 14, an outdoor side heat exchanger 16, an expansion valve 18 which serves as a pressure reducing device, and an indoor side heat exchanger 20; which components are sequentially connected through coolant tubes 22, thereby forming a refrigeration cycle circuit 24 which is capable of performing cooling and heating operations. The four-way valve 14 may be switched between a cooling position and a heating position, and is connected to the exhaust side and the suction side of the compressor 12. The outdoor side heat exchanger 16 is connected to one side of the four-way valve 14, and the indoor side heat exchanger 20 is connected to the other side of the four-way valve 14. The expansion valve 18 is connected between the outdoor side heat exchanger 16 and the indoor side heat exchanger 20.

The expansion valve 18 is connected to a temperature sensor, such as a heat sensitive tube 25 provided at the suction side of the compressor 12, and has its throttling amount controlled on the basis of the coolant temperature detected by the heat sensitive tube 25.

In FIG. 1, reference numeral 26 designates an injection circuit, and numeral 28 designates pipe joints provided at both sides of the indoor side heat exchanger 20. Reference numerals 30 to 33 designate check valves which are so provided as to allow the coolant to flow in a predetermined direction with respect to the expansion valve 18.

A switching control valve 34 is connected between the suction side of the compressor 12 and the four-way valve 14. One end of a first branch passage 36 is connected between the four-way valve 14 and the indoor side heat exchanger 20, and the other end of the passage 36 is connected to the switching control valve 34. A capillary tube 38, which serves as a pressure reducing device and a check valve 80 for allowing the coolant to flow only in the direction of the switching control valve 34 are provided in the first passage 36. One end of a second branch passage 40 is connected between the outdoor side heat exchanger 16 and the expansion valve 18, and the other end of the second passage 40 is connected to the switching control valve 34. A capillary tube 42, which serves as a pressure reducing device and a check valve 44 for allowing the coolant to flow only in the direction of the switching control valve 34 are provided in the second passage 40.

The switching control valve 34 is so controlled by a controlling portion (not shown) as to open only when abnormally high pressure is produced at the high pressure side of the refrigeration cycle 24 during the heating operation, or when a defrosting operation is started. When abnormal high pressure is produced at the high pressure side of the refrigeration cycle 24 at the heating operation and the valve 34 is opened, a releasing circuit passing through the first branch passage 36 is formed, and the above high pressure is released through the first branch passage to the low pressure side of the refrigeration cycle 24. Further, a shortcircuit 46 which passes through the compressor 12, four-way valve 14, outdoor side heat exchanger 16, second branch passage 40 and switching control valve 34 is formed at the defrosting operation.

Figure 2:
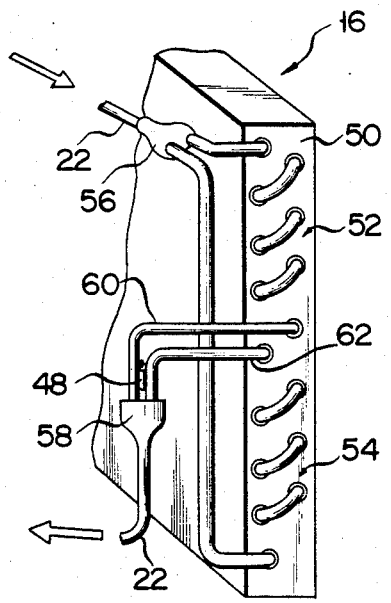
FIGS. 2 and 3 are perspective views of an outdoor side heat exchanger and a defrosting sensor of the above air conditioner.
Figure 3:
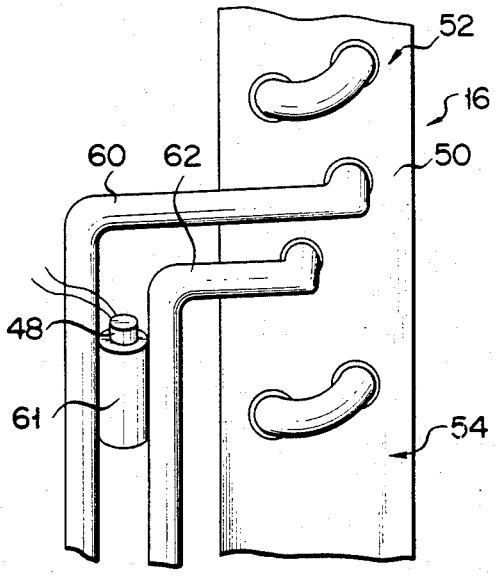

The defrosting operation is controlled on the basis of the coolant temperature detected by a defrosting sensor 48 provided in the vicinity of the outdoor side heat exchanger 16. This sensor 48 is arranged as shown in FIGS. 2 and 3. The outdoor side heat exchanger 16 has a number of fins 50 aligned in parallel with each other, and heat exchanging pipe arrays 52, 54 extending through the upper and lower portions of the fins. These pipe arrays 52, 54 are respectively connected in parallel to the coolant tube 22 through Y-joints 56, 58. The sensor 48 is mounted between coolant tubes 60, 62 which are connected in parallel to the pipe arrays 52, 54 and which become an outlet side of the pipe arrays at the heating operation. The sensor 48 is arranged in a pipe-shaped holder 61, which is fixed, e.g., by soldering, to the coolant tubes 60, 62. The sensor 48 can effectively detect the coolant temperature in the heat exchanging pipes 52, 54, via the mounting structure of the sensor 48 constructed as described above, resulting in a stable performance of the defrosting operation.

The operation of the air conditioner constructed as described above may be described as follows.

When a cooling operation is to be performed, the four-way valve 14 is switched to the cooling position shown in FIG. 1, in a state wherein the switching control valve 34 remains closed. When the compressor 12 is then driven, the coolant sequentially flows as designated by arrows with a solid line, from the compressor 12, through the four-way valve 14, outdoor side heat exchanger 16, expansion vlave 18, indoor side heat exchanger 20 and four-way valve. Thus, a cooling operation is performed, cooling the room.

When a heating operation is to be carried out, the four-way valve 14 is switched to the room heating position, in a state wherein the switching control valve 34 remains closed. When the compressor 12 is then driven, the coolant sequentially flows as designated by arrows with a broken line, from the compressor 12, through the four-way valve 14, indoor side heat exchanger 20, expansion valve 18, outdoor side heat exchanger 16 and four-way valve. Thus, the heating operation is performed, heating the room.

When abnormally high pressure is produced at the high pressure side of the refrigeration cycle 24, due to an overload during the heating operation, the switching control valve 34 is opened by the controlling portion (not shown). Thus, a shortcircuiting releasing circuit is formed through the compressor 12, four-way valve 14, first branch passage 36 and switching valve 34, thereby instantaneously releasing the abnormally high pressure produced at the high pressure side of the refrigeration cycle 24 to the low pressure side thereof.

When frost is produced on the outdoor side that exchanger 16 during the heating operation, the four-way valve 14 is switched to the cooling side by a signal from the defrosting sensor 48, and the switching control valve 34 is opened by the controlling portion (not shown). In this manner, a shortcircuit 46 which passes through the compressor 12, four-way valve 14, outdoor side heat exchanger 16, second branch passage 40 and switching control valve 34 is formed as designated by arrows with a two-dotted line, thereby forming a defrosting cycle. Therefore, the coolant flows in such a way as not to pass the expansion valve 18 which is a primary factor of trouble. Since the first branch passage 36 side falls to a low pressure level, due to the formation of the defrosting cycle, the coolant does not substantially flow.

According to the air conditioner 10 constructed as described above, first and second branch passages 36, 40 are provided, which passages are opened and closed by a sole switching control valve 34. Therefore, the release of the abnormally high pressure and the formation of the shrotcircuit at defrosting time can be performed by the opening and closing operations of the switching control valve 34. Accordingly, it is not necessary to provide an additional switching control valve, thereby reducing the cost of the air conditioner and allowing for the control of operations of two types, by one control system. Further, since only one switching control valve is provided in the air conditioner, the reliability of the air conditioner can be improved. In addition, only the first and second branch passages 36, 40 are provided in the air conditioner, thereby simplifying its structure. Finally, since the coolant does not pass the expansion valve 18 at the defrosting time, the coolant can flow smoothly, with the result that a sufficient defrosting effect can be obtained.

The present invention is not limited to the particular embodiment described above, abd various other changes and modifications may be made within the spirit and scope of the invention. For example, in the embodiment described above, the present invention is applied to an air conditioner having one indoor side heat exchanger for one outdoor side heat exchanger. However, the present invention may also be applied to a multiple air conditioner which has a plurality of indoor side heat exchangers for one outdoor side heat exchanger, as shown in FIG. 4.

Figure 4:
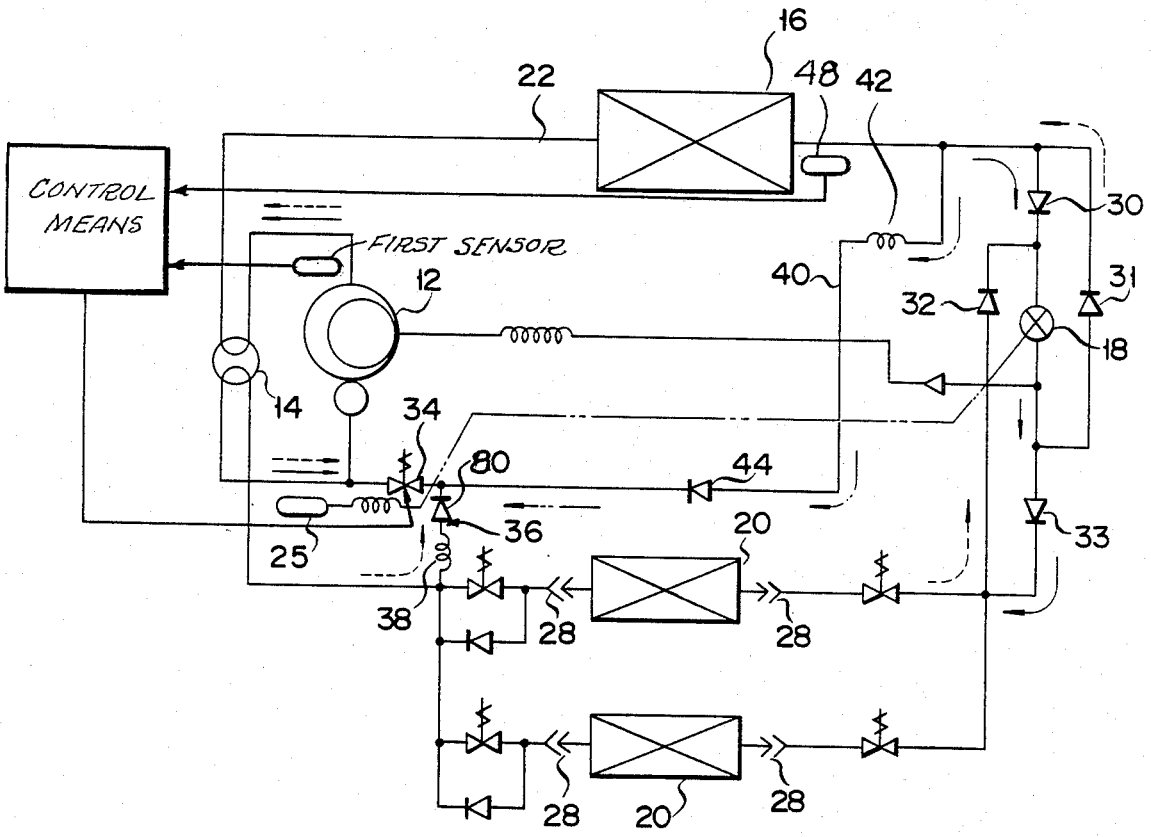
FIG. 4 is a block circuit diagram of an air conditioner according to a modified embodiment of the invention.

As shown in FIG. 4, since the same reference numerals as were used in the embodiment denote the same parts in the embodiment of FIG. 1, a detailed description thereof will be omitted.

What is claimed is:

1. An air conditioner capable of operating in either a cooling mode or a heating mode, as well as in a defrosting mode, comprising:

a compressor;

a four-way valve, connected between the exhaust side and the suction side of the compressor, adapted to be switched between a cooling position and a heating position;

an outdoor side heat exchanger connected to one side of the four-way valve;

a first indoor side heat exchanger connected to the other side of the four-way valve;

an expansion valve, connected between the outdoor side heat exchanger and the indoor side heat exchanger, having a throttling amount that is regulated in response to coolant temperature;

a switching control valve, connected to the suction side of the compressor;

a first sensor for detecting pressure at said high pressure side during heating mode operation;

a second sensor for detecting coolant temperature in said outdoor side heat exchanger during heating mode operation;

a first branch passage connected at a first end thereof between the four-way valve and the indoor side heat exchanger and at a second end thereof to the switching control valve at the side of the switching control valve furthest from said suction side of said compressor, for releasing high pressure produced between the four-way valve and the indoor side heat exchanger, when the switching control valve is opened, during heating mode operation;

a second branch passage, connected at a first end thereof between outdoor side heat exchanger and the expansion valve and at a second end thereof to the switching control valve, for shortcircuiting refrigerant during defrosting mode operation; and control means, responsive to said first and second sensors, for (1) opening the switching control valve when high pressure is produced at a high pressure side of the air conditioner during heating mode operation to produce a shortcircuit through said first branch passage, and (2) opening the switching control valve during defrosting mode operation to produce a shortcircuit through said second branch passage.

2. An air conditioner according to claim 1, which further comprises a first check valve provided within the first branch passage, for allowing the coolant in the first branch passage to flow only in a direction toward the switching control valve; and a second check valve, provided within the second branch passage, for allowing the coolant in the second branch passage to flow only in a direction toward said switching control valve.

3. An air conditioner according to claim 1, wherein said second sensor is a defrosting sensor provided in the vicinity of the outdoor side heat exchanger, for detecting the coolant temperature in the outdoor side heat exchanger at the heating operation and providing to the four-way valve a signal for switching said four-way valve from its heating position to its cooling position, when the coolant temperature falls to a predetermined temperature.

4. An air conditioner according to claim 1, which further comprises a second indoor side heat exchanger connected between the four-way valve and the expansion valve and arranged in parallel with the first indoor side heat exchanger.

5. An air conditioner according to claim 1, which further comprises a temperature sensor provided adjacent to the suction side of the compressor, for detecting the coolant temperature at the suction side of the compressor and feeding a signal for regulating the throttling amount of the expansion valve to the expansion valve.

* * * * *